US011208965B2

(12) United States Patent
Heinken et al.

(10) Patent No.: US 11,208,965 B2
(45) Date of Patent: Dec. 28, 2021

(54) METHOD AND CONTROL DEVICE FOR DETERMINING A DESIRED INTAKE MANIFOLD PRESSURE OF AN INTERNAL COMBUSTION ENGINE

(71) Applicant: Volkswagen Aktiengesellschaft, Wolfsburg (DE)

(72) Inventors: Sebastian Heinken, Braunschweig (DE); Marco Bunjes, Isenbuettel (DE); Tim Thaler, Hannover (DE); Benjamin Frank, Ahnsbeck (DE); Daniel Beese, Braunschweig (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 142 days.

(21) Appl. No.: 16/218,907

(22) Filed: Dec. 13, 2018

(65) Prior Publication Data

US 2019/0178186 A1 Jun. 13, 2019

(30) Foreign Application Priority Data

Dec. 13, 2017 (DE) ..... 10 2017 222 593.9

(51) Int. Cl.
*F02D 41/14* (2006.01)
*F02D 41/00* (2006.01)
*F02D 41/18* (2006.01)

(52) U.S. Cl.
CPC ..... *F02D 41/1406* (2013.01); *F02D 41/0002* (2013.01); *F02D 41/144* (2013.01); *F02D 41/145* (2013.01); *F02D 41/18* (2013.01); *F02D 2200/0402* (2013.01); *F02D 2200/0408* (2013.01); *F02D 2200/0411* (2013.01)

(58) Field of Classification Search
CPC ..... F02D 41/144; F02D 41/145; F02D 41/18; F02D 41/1406; F02D 41/0002; F02D 2200/0402; F02D 2200/0411; F02D 2200/0408
See application file for complete search history.

(56) References Cited

U.S. PATENT DOCUMENTS 6,968,824 B1 * 11/2005 Matthews ..... F02D 41/0002 123/350
7,472,013 B1 12/2008 Wiggins et al.
7,831,378 B2 11/2010 Wills
8,010,276 B2 8/2011 Oehlerking
9,399,944 B2 7/2016 Tsuyuki et al.
(Continued)

FOREIGN PATENT DOCUMENTS

CN 101382092 A 3/2009
CN 101835960 A 9/2010
(Continued)

OTHER PUBLICATIONS

Chinese Office Action for Chinese Application No. 201811524472.1 dated Apr. 1, 2021 with English translation.

*Primary Examiner* — Sizo B Vilakazi
(74) *Attorney, Agent, or Firm* — Muncy, Geissler, Olds & Lowe, P.C.

(57) ABSTRACT

A method for determining a desired intake manifold pressure of an internal combustion engine by means of an iterative method, wherein a cylinder charge is determined for an intake manifold pressure iterated during the iterative method, and the desired intake manifold pressure is determined as a function of the cylinder air charge that has been determined. In addition, a control device for carrying out the method is provided.

19 Claims, 3 Drawing Sheets

(56) References Cited

U.S. PATENT DOCUMENTS

| | | | | |
|---|---|---|---|---|
| 9,605,607 | B2 | 3/2017 | Elsner et al. | |
| 9,810,171 | B2 | 11/2017 | Racelis et al. | |
| 9,964,027 | B2 | 5/2018 | Hagari et al. | |
| 10,018,127 | B2 | 7/2018 | Hoffmeyer et al. | |
| 10,132,260 | B2 | 11/2018 | Meldrum et al. | |
| 10,473,047 | B2 | 11/2019 | Hotta | |
| 2006/0037318 | A1 | 2/2006 | Kloft et al. | |
| 2009/0018751 | A1* | 1/2009 | Buckland | F02B 37/18 701/103 |
| 2013/0111900 | A1* | 5/2013 | Hagner | F02B 37/18 60/602 |
| 2013/0319371 | A1* | 12/2013 | Pursifull | F02D 41/008 123/395 |
| 2015/0152802 | A1 | 6/2015 | Racelis et al. | |
| 2018/0100451 | A1 | 4/2018 | Millich et al. | |
| 2019/0040823 | A1* | 2/2019 | Pursifull | F02D 41/08 |

FOREIGN PATENT DOCUMENTS

| | | | |
|---|---|---|---|
| CN | 102003296 | A | 4/2011 |
| CN | 103299052 | A | 9/2013 |
| CN | 104508282 | A | 4/2015 |
| CN | 105041493 | A | 11/2015 |
| CN | 106460711 | A | 2/2017 |
| CN | 106468220 | A | 3/2017 |
| CN | 107002569 | A | 8/2017 |
| CN | 107131068 | A | 9/2017 |
| DE | 19944178 | A1 | 4/2001 |
| DE | 10241884 | A1 | 5/2004 |
| DE | 10306903 | A1 | 8/2004 |
| DE | 102004046056 | A1 | 3/2006 |
| DE | 102007030233 | A1 | 1/2009 |
| DE | 102013113157 | A1 | 5/2015 |
| DE | 102014001790 | A1 | 8/2015 |
| DE | 102015210761 | A1 | 12/2016 |
| DE | 102016200710 | A1 | 7/2017 |
| EP | 3 059 426 | A1 | 8/2016 |
| FR | 2 861 805 | A1 | 5/2005 |
| JP | 2013-122194 | A | 6/2013 |
| JP | 5776530 | B2 | 9/2015 |
| JP | 2016-173040 | A | 9/2016 |

* cited by examiner

METHOD AND CONTROL DEVICE FOR DETERMINING A DESIRED INTAKE MANIFOLD PRESSURE OF AN INTERNAL COMBUSTION ENGINE

This nonprovisional application claims priority under 35 U.S.C. § 119(a) to German Patent Application No. 10 2017 222 593.9, which was filed in Germany on Dec. 13, 2017, and which is herein incorporated by reference.

BACKGROUND OF THE INVENTION

Field of the Invention

The present invention relates to a method and a control device for determining a desired intake manifold pressure of an internal combustion engine, in particular of a motor vehicle, by means of an iterative method. In addition, the invention relates to a method and a control device for determining a desired exhaust gas back pressure of an internal combustion engine, for example of a motor vehicle, by means of a fixed-point iteration.

DESCRIPTION OF THE BACKGROUND ART

A desired intake manifold pressure, which is to say a desired pressure value in an intake manifold of an internal combustion engine, is normally used for the purpose of determining desired positions of a throttle valve and of a turbocharger of the internal combustion engine in order to control the internal combustion engine while taking the desired positions into account.

DE 199 44 178 A1 discloses a method for controlling a throttle valve, wherein a desired intake manifold pressure is determined from a predefinable desired air mass flow and the throttle valve position is derived on the basis thereof.

To determine the desired intake manifold pressure, typically a gas exchange model of the internal combustion engine is inverted. Such an inversion of the gas exchange model can be inaccurate in places, however, which results in a slowed response characteristic and a torque irregularity of the internal combustion engine of a vehicle and of the vehicle itself.

Moreover, non-invertible gas exchange models also exist. For example, Miller cycle engines require an expanded gas exchange model on account of a high dependence of the camshaft position on a cylinder air charge. Such gas exchange models are not analytically invertible.

SUMMARY OF THE INVENTION

It is therefore an object of the present invention to provide a method and a control device for determining a desired intake manifold pressure that overcomes the above-mentioned disadvantages.

According to an exemplary embodiment, a method for determining a desired intake manifold pressure of an internal combustion engine by means of an iterative method is provided, wherein a cylinder charge is determined for an intake manifold pressure iterated during the iterative method, and the desired intake manifold pressure is determined as a function of the cylinder air charge that has been determined.

Also, provided is a method for determining a desired exhaust gas back pressure of an internal combustion engine by means of a fixed-point method, wherein an iterated exhaust gas back pressure is determined from a quadratic approximation of the equation:

$$\dot{m}_{Abg} = A_{eff}\, p_3 \sqrt{\frac{2}{R_s T_3}}\, \psi\left(c_d;\ \frac{p_4}{p_3}\right), \tag{1}$$

wherein $\dot{m}_{Abg}$ is a desired exhaust gas mass flow, $A_{eff}$ is an effective opening area of a throttle, $p_3$ is a desired exhaust gas back pressure, $p_4$ is a desired pressure after a turbine, $R_s$ is the specific gas constant of the exhaust gas, $T_3$ is an exhaust gas temperature before the turbine, $c_d$ is a turbine flow factor and $\psi(\cdot)$ is a flow function, wherein the desired exhaust gas mass flow is a function of a previously iterated exhaust gas back pressure.

Further, a control device is provided that has a processor that is designed to carry out a method according to the invention.

The present invention relates to a method for determining a desired intake manifold pressure of an internal combustion engine by means of an iterative method. The desired intake manifold pressure is typically a desired pressure that should prevail in an intake manifold of an internal combustion engine that is designed to deliver fresh air into a cylinder of the internal combustion engine.

In the process of determining the desired intake manifold pressure, a cylinder charge is determined for an intake manifold pressure iterated during the iterative method. The cylinder charge of an internal combustion engine is composed, for example, of different constituent amounts of charge components within the cylinder of the internal combustion engine, such as fresh air, residual gas, and/or scavenged air. The cylinder charge can be represented by what are called air mass flow curves of the internal combustion engine. The cylinder charge can be based on a non-invertible gas exchange model and can be determined as a function of desired camshaft positions, a current actual speed at a current operating point of the internal combustion engine, a desired exhaust gas back pressure for the iterated intake manifold pressure, and the iterated intake manifold pressure.

The desired intake manifold pressure is then determined as a function of the cylinder air charge that has been determined. The determination of the desired intake manifold pressure is described in detail below.

The desired intake manifold pressure can also be determined for non-invertible gas exchange models without great effort. The desired intake manifold pressure can be determined with sufficiently high accuracy to result in a high potential for $CO_2$ saving through small ignition angle interventions in near-idle operation, rapid and harmonious torque buildup and torque reduction in the dynamics, and stable conditions for leak diagnosis in a pressure section, and thereby early fault detection for protection of equipment.

The iterative method can be a secant method. In this case, for example two starting points are defined and a secant is drawn between these starting points. Next, a point of intersection of the secant with an X axis, in the present case an axis that specifies a desired intake manifold pressure, is defined as an iterated value that represents an improved initial value for a subsequent iteration. With the aid of the secant method, it is even possible to perform an iterative inversion of air mass flow curves that are not differentiable.

A cylinder charge can be determined for a first initial intake manifold pressure, and a second initial intake manifold pressure can be determined by the means that the cylinder charge for the first initial intake manifold pressure is compared with a desired cylinder charge of the internal combustion engine, and the second initial intake manifold pressure is determined as a function of the result of the comparison between the cylinder charge for the first initial intake manifold pressure and the desired cylinder charge. To determine the second initial intake manifold pressure $p_{S2}$ the following may apply, for example:

$$p_{S2} = \begin{cases} p_{S2,max}, & \text{if } r_0 \leq r_{soll} \\ p_{S2,min}, & \text{if } r_0 > r_{soll} \end{cases}, \quad (2)$$

wherein $r_0$ is the cylinder charge for the first initial intake manifold pressure and $r_{soll}$ is the desired cylinder charge of the internal combustion engine. The values $p_{S2,max}$ and $p_{S2,min}$ can be read from characteristic maps. The characteristic maps preferably depend on a speed and the desired cylinder charge, wherein the characteristic maps preferably are populated with data such that a search region for the desired cylinder charge is as small as possible, but the desired cylinder charge that is sought is always within the search region. Subsequently, a cylinder charge can likewise be determined for the second initial intake manifold pressure.

The first initial intake manifold pressure can be an actual intake manifold pressure. The actual intake manifold pressure can be a pressure that is currently prevailing in the intake manifold, which preferably is measured by means of a pressure sensor in the intake manifold or is determined on the basis of other measured parameters.

The iterated intake manifold pressure can be determined on the basis of the first initial intake manifold pressure and the second initial intake manifold pressure by means of the secant method. For this purpose, a quantity that depends on the intake manifold pressure can be plotted over the intake manifold pressure for the first initial intake manifold pressure and for the second initial intake manifold pressure, and a secant can be drawn through the intake-manifold-dependent quantity at the first initial intake manifold pressure and at the second initial intake manifold pressure. The point of intersection of the secant with the X axis (intake manifold pressure axis) can then represent the iterated intake manifold pressure (first iterated intake manifold pressure). Analogously, additional iterated intake manifold pressures can be determined on the basis of the second initial intake manifold pressure and/or the first iterated intake manifold pressure.

The iterated intake manifold pressure can additionally be determined as a function of the cylinder charge for the first initial intake manifold pressure and of the cylinder charge for the second initial intake manifold pressure. Thus, for example, the cylinder charge for the first initial intake manifold pressure and the cylinder charge for the second initial intake manifold pressure can be plotted over the intake manifold pressure and a secant can be drawn through the cylinder charge at the first initial intake manifold pressure and the cylinder charge at the second initial intake manifold pressure. The intersection of the secant with the X axis (intake manifold pressure axis) can then represent the iterated intake manifold pressure (first iterated intake manifold pressure). Next, a cylinder charge for the first iterated intake manifold pressure can be determined, this can be plotted over the intake manifold pressure, a secant can be drawn between the cylinder charge at the second initial intake manifold pressure and the cylinder charge at the first iterated intake manifold pressure, and the intersection of the secant with the X axis can be read off as the second iterated intake manifold pressure. Analogously, additional iterated intake manifold pressures can be determined on the basis of the cylinder charge at the first iterated intake manifold pressure and/or the cylinder charge at the second iterated intake manifold pressure.

The iteration by means of the secant method can be terminated after two or three iteration steps, for example. This means, for example, that two initial value calculations for the current intake manifold pressure and a boundary value for the intake manifold pressure (determined by means of maximum and minimum characteristic maps) are determined first, and two or three iteration steps then follow. A maximum number of iteration steps, for example two or three iteration steps, can be defined in advance, for example by an application engineer.

The cylinder charge for the iterated intake manifold pressure can be determined as a function of a desired turbocharger speed. For example, the desired turbocharger speed can be determined as a function of the intake manifold pressure on which the iteration step is based. For example, the turbocharger speed for determining the cylinder charge for the first initial intake manifold pressure can be determined from the first initial intake manifold pressure, the turbocharger speed for determining the cylinder charge for the second initial intake manifold pressure can be determined from the second initial intake manifold pressure, and the turbocharger speed for determining the cylinder charge for the first iterated intake manifold pressure can be determined from the first iterated intake manifold pressure. Analogously, the turbocharger speeds for determining the cylinder charge for an additional iterated intake manifold pressure can depend on the relevant additional iterated intake manifold pressure.

The cylinder charge for the iterated intake manifold pressure can be determined as a function of a desired exhaust gas back pressure, wherein the desired exhaust gas back pressure can be determined as a function of the intake manifold pressure on which the iteration step is based. For example, the desired exhaust gas back pressure for determining the cylinder charge for the first initial intake manifold pressure can be determined from the first initial intake manifold pressure, the desired exhaust gas back pressure for determining the cylinder charge for the second initial intake manifold pressure can be determined from the second initial intake manifold pressure, and the desired exhaust gas back pressure for determining the cylinder charge for the first iterated intake manifold pressure can be determined from the first iterated intake manifold pressure. Analogously, the desired exhaust gas back pressures for determining the cylinder charge for an additional iterated intake manifold pressure can depend on the relevant additional iterated intake manifold pressure. Preferably, the desired exhaust gas back pressure can additionally be determined as a function of the desired turbocharger speed determined in the corresponding step.

The desired exhaust gas back pressure is thus unknown and is determined in the course of the method, in particular during each calculation step or iteration step. For example, a desired exhaust gas back pressure is also determined for the purpose of determining the cylinder charge for the first initial intake manifold pressure and for the second initial intake manifold pressure. As a general rule, therefore, the air mass flow curves for the target camshaft positions, the target exhaust gas back pressure, and the current speed should be inverted in order to calculate a desired intake manifold pressure from the desired charge. The target camshaft positions are preferably known, and can be determined from speed- and torque-dependent characteristic maps and/or from speed- and charge-dependent characteristic maps, for example.

The desired exhaust gas back pressure can be determined from a quadratic approximation of the equation:

$$\dot{m}_{Abg} = A_{eff}\, p_3 \sqrt{\frac{2}{R_s T_3}}\, \psi\left(c_d;\ \frac{p_4}{p_3}\right), \tag{1}$$

wherein $\dot{m}_{Abg}$ is a desired exhaust gas mass flow, $A_{eff}$ is an effective opening area of a throttle, $p_3$ is a desired exhaust gas back pressure, $p_4$ is a desired pressure after a turbine, $R_s$ is the specific gas constant of the exhaust gas, $T_3$ is an exhaust gas temperature before the turbine, $c_d$ is a turbine flow factor and $\psi(\cdot)$ is a flow function. The specific gas constant of the exhaust gas $R_s$ can be assumed as, e.g., $R_s$=288 J/kgK or a similar value. The quadratic approximation of the equation (1) solved for the exhaust gas back pressure $p_3$ can have the following form:

$$p_3 = -\frac{(3c_d^2 - 2c_d\kappa_{Abg})p_4}{2c_d\kappa_{Abg} - 3c_d^2} \pm \sqrt{\left(\frac{(3c_c^2 - 2c_d\kappa_{Abg})p_4}{2c_d\kappa_{Abg} - 3c_d^2}\right)^2 + \frac{3c_d^2 p_4^2 A_{eff}^2 + \dot{m}_{Abg}^2 R_s T_3 \kappa_{Abg}}{A_{eff}^2(2c_d\kappa_{Abg} - 3c_d^2)}} \tag{3}$$

Here, $K_{Abg}$ is the isentropic exponent of the exhaust gas. The isentropic exponent can be $K_{Abg}$=1.37 or a similar value, for example.

The desired exhaust gas back pressure can be determined by means of an iterative method. The iterative method for determining the desired exhaust gas back pressure can be a fixed-point iteration. In this process, the exhaust gas back pressure preferably can be determined repetitively on the basis of Equation (3).

An initial exhaust gas back pressure can be the first initial intake manifold pressure, the second initial intake manifold pressure, or the iterated intake manifold pressure. During the determination of the desired exhaust gas back pressure that is used for determining the cylinder charge for the first initial intake manifold pressure, the initial exhaust gas back pressure can be the first initial intake manifold pressure. During the determination of the desired exhaust gas back pressure that is used for determining the cylinder charge for the second initial intake manifold pressure, the initial exhaust gas back pressure can be the second initial intake manifold pressure. During the determination of the desired exhaust gas back pressure that is used for determining the cylinder charge for the first iterated initial intake manifold pressure, the initial exhaust gas back pressure can be the first iterated intake manifold pressure. Analogously, additional iterated intake manifold pressures can be used as the initial exhaust gas back pressure when determining the relevant desired exhaust gas back pressures.

A reduced exhaust gas mass flow and a VTG drive duty cycle (VTG—variable turbine geometry) of a turbocharger with VTG can be determined as a function of the initial exhaust gas back pressure or of the iterated exhaust gas back pressure, and the subsequent iterated exhaust gas back pressure can be determined as a function thereof. Moreover, in this process the VTG drive duty cycle can be determined by means of the reduced mass flow. In particular, it is possible to repeatedly determine a reduced mass flow based on an initial exhaust gas back pressure, determine a VTG drive duty cycle (VTG drive) based on the reduced mass flow, and lastly calculate the iterated exhaust gas back pressure. For the determination of the VTG drive duty cycle, a stationary precontrol map, which preferably is a function of the underlying exhaust gas back pressure and the reduced mass flow, can be evaluated in each iteration.

Alternatively or in addition to the VTG drive duty cycle, an adjustment of a wastegate actuator of a turbocharger having a wastegate actuator can be determined and can be taken into account in determining the subsequent iterated exhaust gas back pressure. The procedure preferably is analogous to that for a turbocharger with VTG.

The iteration by means of the fixed-point iteration can be terminated after two or three iteration steps, for example. In other words, an initial value calculation for the initial exhaust gas back pressure, for example the current intake manifold pressure (actual intake manifold pressure) is carried out first, and two or three iteration steps follow thereafter. A maximum number of iteration steps can be defined in advance, for example by an application engineer.

When a desired exhaust gas back pressure takes on the value of an actual exhaust gas back pressure in a stationary state, the desired exhaust gas back pressure can be overlaid in a stationary fashion. The actual exhaust gas back pressure can then be an exhaust gas back pressure measured by means of a sensor. The stationary overlaying results in an improvement in accuracy.

Alternatively, the exhaust gas back pressure can be calculated with Equation (3) in each calculation step or iteration step, and a reduced mass flow can be determined. To this end, an approximation by means of the following equation can take place, for example:

$$\dot{m}_{Abg,red} = \dot{m}_{Abg}\frac{\sqrt{T_3}}{p_3} \tag{4}$$

From this, the VTG drive duty cycle and/or the adjustment of the actuator of the turbocharger having a wastegate can be determined.

The exhaust gas back pressure can alternatively be determined from a desired pressure after a turbine and a power balance of the turbine and of a compressor. This represents a simplification as compared to the evaluation of Equation (3), but leads to less accurate results.

In summary, the present invention is distinguished by the manner of the iterative calculation of the gas exchange model in combination with the inversion of the approximately linear engine mass flow characteristic, wherein a calculation of the desired value of the exhaust gas back pressure is meant to be carried out at a destination point. This does not require any directional derivatives of the gas exchange model, which are used in prior art methods.

Furthermore, the invention relates to a method for determining a desired exhaust gas back pressure of an internal combustion engine by means of a fixed-point method, wherein an iterated exhaust gas back pressure is determined from a quadratic approximation of the equation:

$$\dot{m}_{Abg} = A_{eff}\, p_3 \sqrt{\frac{2}{R_s T_3}}\, \psi\left(c_d;\ \frac{p_4}{p_3}\right), \tag{1}$$

wherein $\dot{m}_{Abg}$ is a desired exhaust gas mass flow, $A_{eff}$ is an effective opening area of a throttle, $p_3$ is a desired exhaust gas back pressure, $p_4$ is a desired pressure after a turbine, $R_s$ is the specific gas constant of the exhaust gas, $T_3$ is an exhaust gas temperature before the turbine, $c_d$ is a turbine flow factor and $\psi(\cdot)$ is a flow function, wherein the desired exhaust gas mass flow is a function of an initial exhaust gas back pressure or of a previously iterated exhaust gas back pressure. Equation (3) above can provide the quadratic approximation.

The desired exhaust gas back pressure can correspond to the iterated exhaust gas back pressure after two or three iteration steps.

Additional details of the method for determining a desired exhaust gas back pressure have been described in detail above with regard to the method for determining the desired intake manifold pressure. These features apply analogously to the method for determining a desired exhaust gas back pressure.

The invention additionally relates to a control device for an internal combustion engine that has a processor that is designed to carry out a method for determining a desired intake manifold pressure of an internal combustion engine by means of an iterative method, wherein a cylinder charge is determined for an intake manifold pressure iterated during the iterative method and the desired intake manifold pressure is determined as a function of the cylinder air charge that has been determined. In particular, the processor is designed to carry out the above-described method for determining a desired intake manifold pressure.

The control device can be an engine control unit, for example. The control device can also have a data memory for storage of characteristic maps, algorithms, iteration instructions, defined parameters, and/or the like. Furthermore, the control device can have a signal input for receiving data, for example measurement data or other data, and a signal output for issuing control signals to the internal combustion engine, in particular the controllable components of the internal combustion engine.

The invention additionally relates to a control device for an internal combustion engine that has a processor that is designed to carry out a method for determining a desired exhaust back pressure as is described above.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
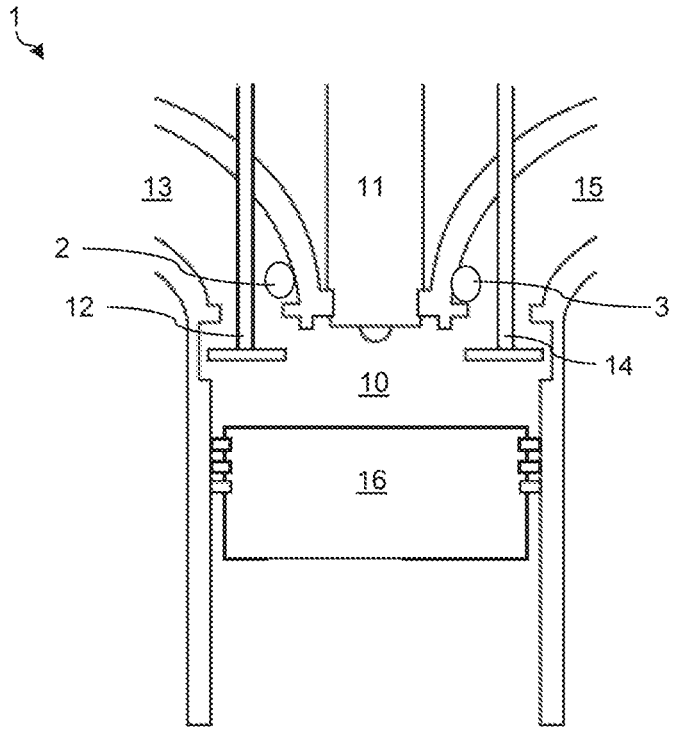
FIG. 1 schematically shows an internal combustion engine.

An internal combustion engine is shown schematically in FIG. 1. A cylinder 1 has a combustion chamber 10, in which the combustion of fuel that is injected through an injection valve 11 takes place. The cylinder 1 is coupled by an intake valve 12 to an intake manifold 13, from which fresh air arrives in the combustion chamber 10 through the intake valve 12. In addition, the cylinder 1 is coupled by an exhaust valve 14 to an exhaust manifold 15, through which the exhaust gas or residual gas is directed out of the combustion chamber 10 into the exhaust manifold 15. Furthermore, a cylinder piston 16 is present that is driven by a crankshaft. Located in the intake manifold 13 directly ahead of the intake valve 12 is an intake manifold pressure sensor 2, which is designed to detect an intake manifold pressure. Located in the exhaust manifold 15 directly behind the exhaust valve 14 is an exhaust back pressure sensor 3, which is designed to detect an exhaust gas back pressure. In FIG. 1, the cylinder 1 is represented at a point in time when the intake valve 12 and the exhaust valve 14 are open and a valve overlap is present.

Figure 2:
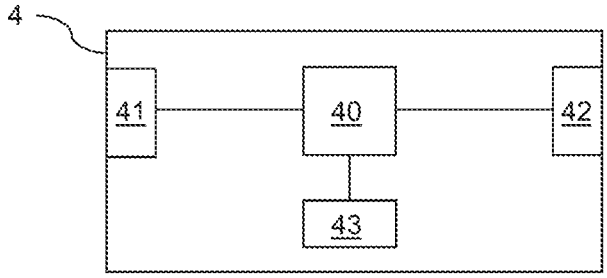
FIG. 2 schematically shows a control device for carrying out a method for determining a desired intake manifold pressure.

FIG. 2 shows a schematic representation of a control device 4 for carrying out a method for determining a desired intake manifold pressure. The control device 4 has a processor 40 that is connected to a signal input 41 for receiving data and a signal output 42 for issuing control commands to the internal combustion engine. The control device 4 also has a data memory 43 that is provided for storage of characteristic maps, algorithms, iteration instructions, defined parameters, and the like. The processor 40 is designed to carry out a method for determining a desired intake manifold pressure, as is described below with reference to FIG. 3 to FIG. 6.

Figure 3:
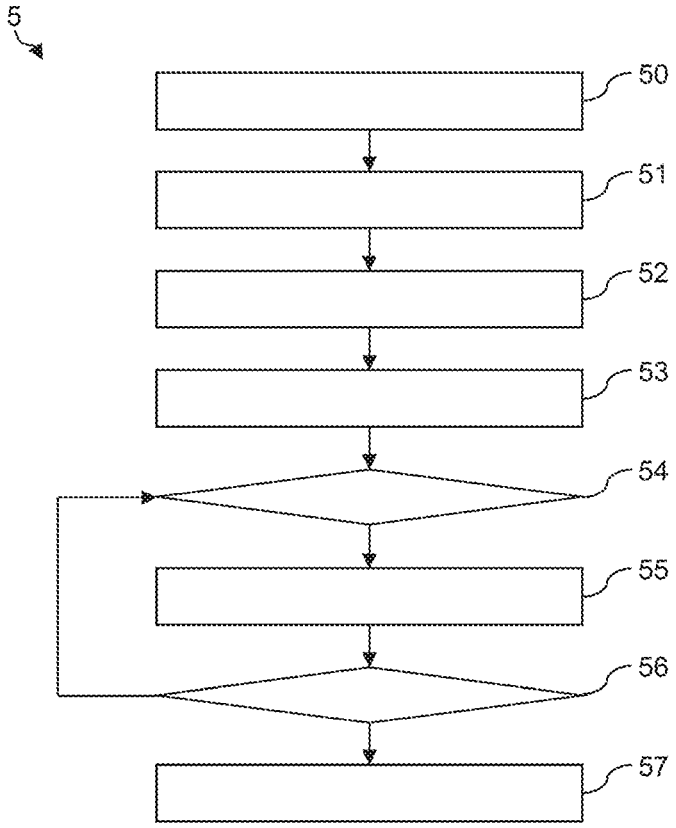
FIG. 3 schematically shows a flowchart of an exemplary embodiment of a method for determining a desired intake manifold pressure.

FIG. 3 shows a flowchart of a method 5 for determining a desired intake manifold pressure.

Firstly, at 50 a first initial intake manifold pressure is determined. To this end, an actual intake manifold pressure, which serves as the first initial intake manifold pressure, is measured by means of the intake manifold pressure sensor.

Next, at 51 a cylinder charge is determined for the first initial intake manifold pressure.

Figure 4:
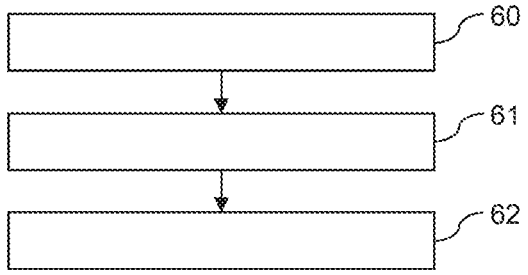
FIG. 4 schematically shows a flowchart of a method for determining the cylinder charge.

To this end, as is shown in the diagram in FIG. 4, a desired turbocharger speed is determined at 60 as a function of the first initial intake manifold pressure. A desired exhaust gas back pressure is determined at 61 as a function of the first initial intake manifold pressure and the desired turbocharger speed that has been determined. The calculation of the desired exhaust gas back pressure is described below in detail with reference to FIG. 6. Next, at 62 the cylinder charge is determined as a function of the first initial intake manifold pressure and the desired exhaust gas back pressure.

At 52 in FIG. 3, a second initial intake manifold pressure is determined as a function of the cylinder charge for the first initial intake manifold pressure. To this end, the cylinder charge for the first initial intake manifold pressure is compared with a desired cylinder charge of the internal combustion engine, and as a function of the result of the comparison an upper limit value $p_{S2,max}$ or a lower limit value $p_{S2,min}$ is defined as the second initial intake manifold pressure according to Equation (2) above from a characteristic map that defines a search region.

At 53 a cylinder charge for the second initial intake manifold pressure is determined. The determination of the cylinder charge for the second initial intake manifold pressure takes place analogously to the determination of the cylinder charge for the first initial intake manifold pressure.

Figure 5:
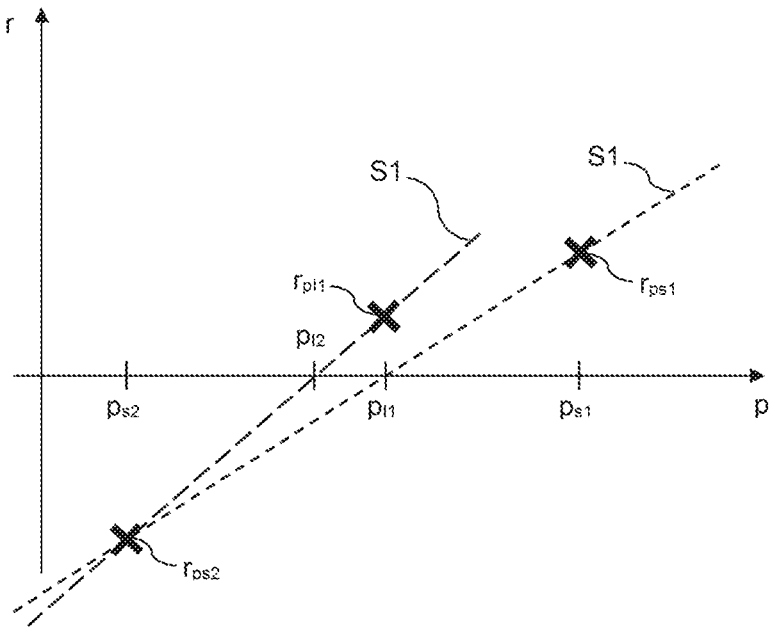
FIG. 5 schematically shows the basic principle of a secant method.
Figure 6:
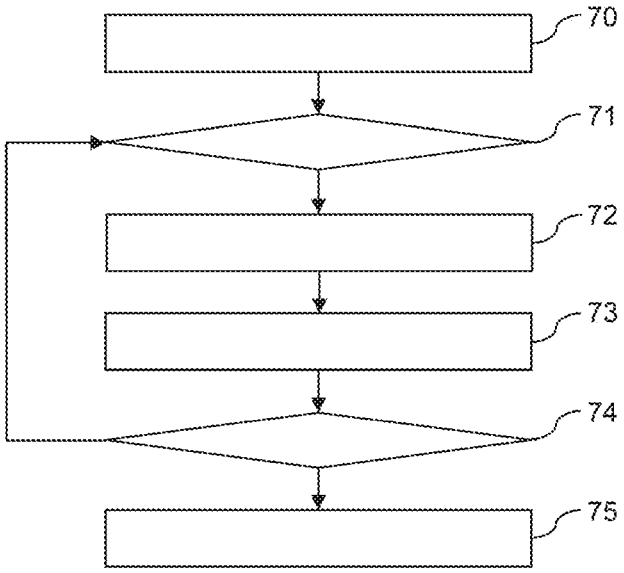
FIG. 6 schematically shows a flowchart of an iterative method for determining a desired exhaust back pressure.

At 54 a first iterated intake manifold pressure is determined by means of a secant method. to this end, as is shown in FIG. 5, the cylinder charge $r_{ps2}$ for the first initial intake manifold pressure $p_{s1}$ and the cylinder charge $r_{ps2}$ for the second initial intake manifold pressure $p_{s2}$ are plotted over the intake manifold pressure p (X axis), and a secant S1 is drawn between the cylinder charges $r_{ps1}$, $r_{ps2}$. A point of intersection of the secant S1 with the X axis represents the first iterated intake manifold pressure $p_{l1}$.

At 55 a cylinder charge is determined for the first iterated intake manifold pressure that has been determined. The determination of the cylinder charge for the first iterated intake manifold pressure takes place analogously to the determination of the cylinder charge for the first initial intake manifold pressure.

At 56 it is determined whether or not the iteration can be terminated. This can be determined as a function of a number of iterations already carried out or as a function of the cylinder charge for the first iterated intake manifold pressure. For example, the charge for the first iterated intake manifold pressure can be compared with the charge for the second initial intake manifold pressure, and a decision as to whether or not the iteration can be terminated can be made as a function of the result of the comparison.

If it is determined at 56 that the iteration can be terminated, at 57 the last iterated intake manifold pressure that has been determined is output as the desired intake manifold pressure.

If it is determined at 56 that the iteration cannot be terminated, the steps 54 to 56 are repeated. In so doing, at 54 a second iterated intake manifold pressure is determined by the means that, as shown in FIG. 5, a secant S2 is drawn through the cylinder charge $r_{ps2}$ for the second initial intake manifold pressure and the cylinder charge $r_{pl1}$ for the first iterated intake manifold pressure, and a point of intersection with the X axis is defined as the second iterated intake manifold pressure $p_{l2}$. At 55 the cylinder charge for the second iterated intake manifold pressure is then defined, and at 56 it is determined whether or not the iteration can be terminated. To this end, the charge for the second iterated intake manifold pressure can be compared with the charge for the first iterated intake manifold pressure, and a decision as to whether or not the iteration can be terminated can be made as a function of the result of the comparison. If the iteration cannot be terminated, the steps 54 to 56 are repeated analogously for additional iterated intake manifold pressures.

The iteration is repeated, for example a maximum of two times, and is then terminated. However, the maximum number of iterations can be defined in advance.

In the first exemplary embodiment, the desired exhaust gas back pressure for determining a charge is determined for each of the initial intake manifold pressures and iterated intake manifold pressures according to the method 7 for determining a desired exhaust gas back pressure.

At 70 an initial exhaust gas back pressure is defined. The initial exhaust gas back pressure is the intake manifold pressure that was used as a starting point in the relevant step of the method 5 for determining the desired intake manifold pressure. In other words, in step 51 of the method 5 the initial exhaust gas back pressure is the first initial intake manifold pressure, in step 53 it is the second initial intake manifold pressure, and in step 55 it is the iterated exhaust gas back pressure that was iterated in step 54.

At 71 a reduced mass flow is determined as a function of the initial exhaust gas back pressure.

At 72 a VTG drive duty cycle or an adjustment of an actuator of a turbocharger having a wastegate is then determined as a function of the initial intake manifold pressure and the reduced mass flow.

At 73 an iterated exhaust gas back pressure is determined by means of Equation (3) above. Steps 71 to 73 each represent an iteration step of a fixed-point iteration.

At 74 it is determined whether or not the iteration can be terminated. This is determined as a function of a number of iterations already carried out. The maximum number of iterations is 2 here.

If it is determined at 74 that the iteration can be terminated, at 75 the last iterated exhaust gas back pressure that has been determined is output as the desired exhaust gas back pressure.

If it is determined at 74 that the iteration cannot be terminated, the steps 71 to 74 are repeated. In so doing, in each case a reduced exhaust gas mass flow, a VTG drive duty cycle or an adjustment of an actuator of a turbocharger having a wastegate, and an additional iterated exhaust gas back pressure are determined as a function of the iterated exhaust gas back pressure.

In a second exemplary embodiment, the exhaust gas back pressure is calculated at each calculation step 51, 53, 54 of the method 5 by means of Equation (3) above, and a reduced mass flow is determined with Equation (4) above. Then, the VTG drive duty cycle or the adjustment of the actuator of the turbocharger having a wastegate are determined therefrom.

In a third exemplary embodiment, the desired exhaust gas back pressure is determined at each calculation step 51, 53, 54 of the method 5 from a desired pressure after a turbine and a power balance of the turbine and of a compressor.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for determining a desired intake manifold pressure of an internal combustion engine via an iterative method, the method comprising:

determining a cylinder charge for an intake manifold pressure iterated during the iterative method; and determining the desired intake manifold pressure as a function of the cylinder charge that has been determined, wherein the desired intake manifold pressure is an iterated value representing an improved initial value for a subsequent iteration.

2. A method for determining a desired intake manifold pressure of an internal combustion engine via an iterative method, the method comprising:

determining a cylinder charge for an intake manifold pressure iterated during the iterative method; and determining the desired intake manifold pressure as a function of the cylinder charge that has been determined, wherein the iterative method is a secant method.

3. The method according to claim 2, wherein a cylinder charge is determined for a first initial intake manifold pressure, and a second initial intake manifold pressure is determined in that the cylinder charge for the first initial intake manifold pressure is compared with a desired cylinder charge of the internal combustion engine, and wherein the second initial intake manifold pressure is determined as a function of the result of the comparison between the cylinder charge for the first initial intake manifold pressure and the desired cylinder charge.

4. The method according to claim 3, wherein the first initial intake manifold pressure is an actual intake manifold pressure.

5. The method according to claim 3, wherein the iterated intake manifold pressure is determined based on the first initial intake manifold pressure and the second initial intake manifold pressure is determined via the secant method.

6. The method according to claim 5, wherein the iterated intake manifold pressure is additionally determined as a function of the cylinder charge for the first initial intake manifold pressure and of the cylinder charge for the second initial intake manifold pressure.

7. A method for determining a desired intake manifold pressure of an internal combustion engine via an iterative method, the method comprising:

determining a cylinder charge for an intake manifold pressure iterated during the iterative method; and determining the desired intake manifold pressure as a function of the cylinder charge that has been determined, wherein the cylinder charge for the iterated intake manifold pressure is determined as a function of a desired exhaust gas back pressure, and wherein the desired exhaust gas back pressure is determined as a function of the iterated intake manifold pressure.

8. The method according to claim 7, wherein the desired exhaust gas back pressure is determined from a quadratic approximation of the equation:

$$\dot{m}_{Abg} = A_{eff}\, p_3 \sqrt{\frac{2}{R_s T_3}}\, \psi\left(c_d;\ \frac{p_4}{p_3}\right),$$

wherein $\dot{m}_{Abg}$ is a desired exhaust gas mass flow, $A_{eff}$ is an effective opening area of a throttle, $p_3$ is a desired exhaust gas back pressure, $p_4$ is a desired pressure after a turbine, $R_s$ is the specific gas constant of the exhaust gas, $T_3$ is an exhaust gas temperature before the turbine, $c_d$ is a turbine flow factor and $\psi(\cdot)$ is a flow function.

9. The method according to claim 7, wherein the desired exhaust gas back pressure is determined by an iterative method.

10. The method according to claim 9, wherein an initial exhaust gas back pressure is the iterated intake manifold pressure.

11. The method according to claim 10, wherein a reduced exhaust gas mass flow and a VTG drive duty cycle are determined as a function of the initial exhaust gas back pressure, and the iterated exhaust gas back pressure is determined as a function thereof.

12. The method according to claim 7, wherein the desired intake manifold pressure is determined from a desired pressure after a turbine and from a power balance of the turbine and of a compressor.

13. A method comprising:

determining a desired exhaust gas back pressure of an internal combustion engine via a fixed-point method; and determining an iterated exhaust gas back pressure from a quadratic approximation of the equation:

$$\dot{m}_{Abg} = A_{eff}\, p_3 \sqrt{\frac{2}{R_s T_3}}\, \psi\left(c_d;\ \frac{p_4}{p_3}\right),$$

wherein $\dot{m}_{Abg}$ is a desired exhaust gas mass flow, $A_{eff}$ is an effective opening area of a throttle, $p_3$ is the desired exhaust gas back pressure, $p_4$ is a desired pressure after a turbine, $R_s$ is the specific gas constant of the exhaust gas, $T_3$ is an exhaust gas temperature before the turbine, $c_d$ is a turbine flow factor and $\psi(\cdot)$ is a flow function, wherein the desired exhaust gas mass flow is a function of a previously iterated exhaust gas back pressure.

14. The method according to claim 13, wherein the desired exhaust gas back pressure corresponds to the iterated exhaust gas back pressure after two iteration steps.

15. A control device for an internal combustion engine, the control device comprising a processor designed to carry out the method according to claim 1.

16. The method according to claim 1, wherein said iterative method comprises multiple iteration steps.

17. The method according to claim 1, wherein said determining the desired intake manifold pressure comprises an iterative calculation.

18. The method according to claim 1, further comprising:

determining a first initial intake manifold pressure;

determining a cylinder charge for the first initial intake manifold pressure;

determining a second initial intake manifold pressure as a function of the cylinder charge for the first initial intake manifold pressure;

determining a cylinder charge for the second initial intake manifold pressure;

determining a first iterated intake manifold pressure;

determining a cylinder charge for the first iterated intake manifold pressure; and determining whether the iteration can be terminated.

19. The method according to claim 18, further comprising repeating the iteration.

* * * * *